US007293378B2

(12) United States Patent
Bihr

(10) Patent No.: US 7,293,378 B2
(45) Date of Patent: Nov. 13, 2007

(54) DEVICE FOR TENSIONING AND SECURING A CANVAS

(75) Inventor: Eric Bihr, Meys (FR)

(73) Assignee: Prismaflex International, Haute Rivoire (FR)

( * ) Notice: Subject to any disclaimer, the term of this patent is extended or adjusted under 35 U.S.C. 154(b) by 2 days.

(21) Appl. No.: 11/321,909

(22) Filed: Dec. 29, 2005

(65) Prior Publication Data

US 2006/0101759 A1 May 18, 2006

Related U.S. Application Data

(63) Continuation of application No. PCT/FR2004/050293, filed on Jun. 24, 2004.

(30) Foreign Application Priority Data

Jul. 9, 2003 (FR) ..... 03 08381

(51) Int. Cl.
*D05C 1/02* (2006.01)
*D05C 9/04* (2006.01)

(52) U.S. Cl. ..... 38/102.91; 160/395

(58) Field of Classification Search ..... 38/102.91, 38/102.3, 102.1, 102.5, 102.7; 160/380, 160/382, 391, 392, 395, 399, 401, 402, 403; 40/700, 603, 732; 52/222
See application file for complete search history.

(56) References Cited

U.S. PATENT DOCUMENTS 2,630,170 A * 3/1953 Ewing ..... 160/392
3,186,712 A * 6/1965 Kessler ..... 473/113
3,769,730 A * 11/1973 Dole ..... 40/732
3,914,887 A * 10/1975 Newman ..... 38/102.8
4,333,284 A * 6/1982 Meadows ..... 52/222
4,341,255 A * 7/1982 Mock ..... 160/369
4,690,192 A * 9/1987 Stilling ..... 160/57
4,937,961 A * 7/1990 Gandy et al. ..... 40/603
4,947,561 A 8/1990 Delacroix et al.
6,253,471 B1 7/2001 Strauh
6,314,684 B1 * 11/2001 Aviram ..... 52/11

FOREIGN PATENT DOCUMENTS

| | | |
|---|---|---|
| BE | 848203 A7 | 3/1977 |
| DE | 440741 C1 | 2/1927 |
| DE | 441653 C1 | 3/1927 |
| DE | 295 03 438 U1 | 4/1995 |
| FR | 1355914 A1 | 3/1964 |
| FR | 2639879 A2 | 6/1990 |

* cited by examiner

*Primary Examiner*—Ismael Izaguirre
(74) *Attorney, Agent, or Firm*—Burr & Brown

(57) ABSTRACT

A device for tensioning and maintaining a canvas, comprising a frame having a groove, and at least one deformable batten. The canvas is stretched and maintained on the frame by wedging it between the groove and the deformable batten. The deformable batten comprises a substantially V-shaped section which is oriented towards the bottom of the groove, a sharp edge which is used as a pivot to enable the deformation thereof, and two flanks which are used to wedge the canvas in the groove. The invention is characterized in that the batten is locked in a narrow section of the groove by two enlargements extending on one flank of the batten in the same direction as the batten.

7 Claims, 1 Drawing Sheet

Fig. 1
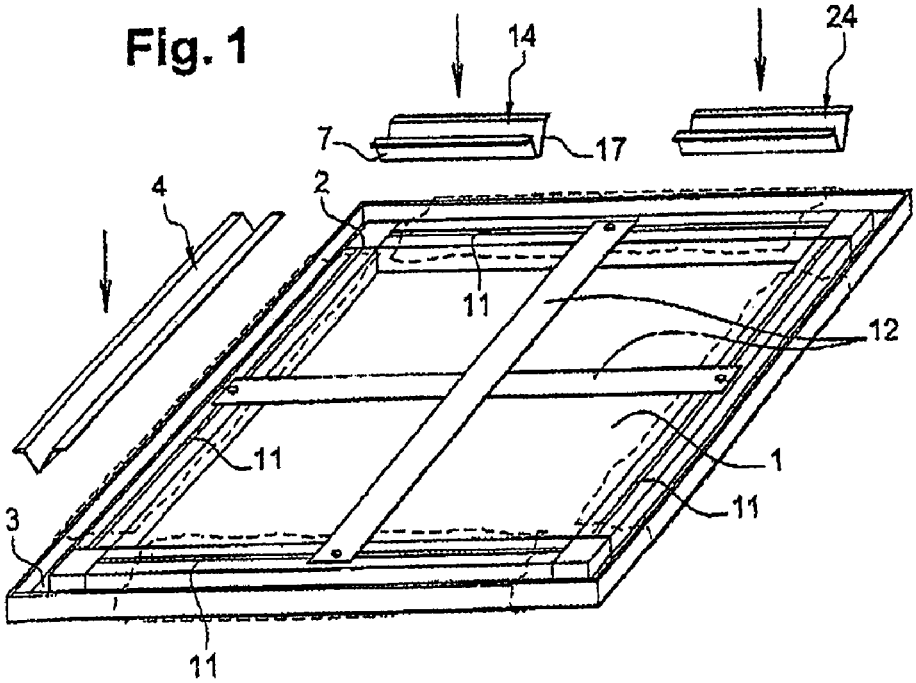
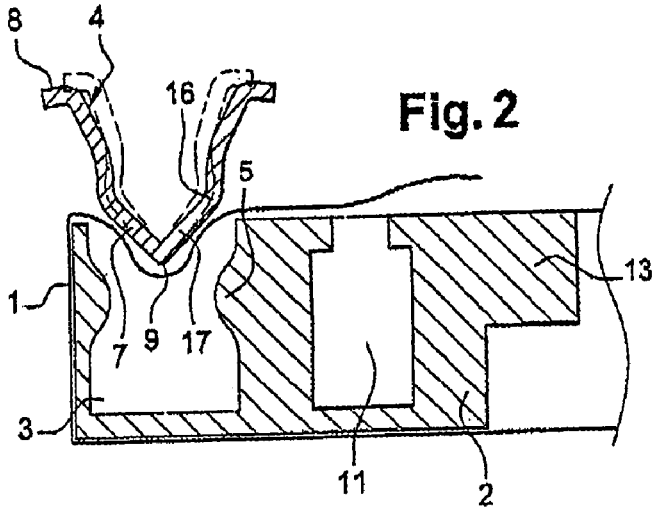
Fig. 2
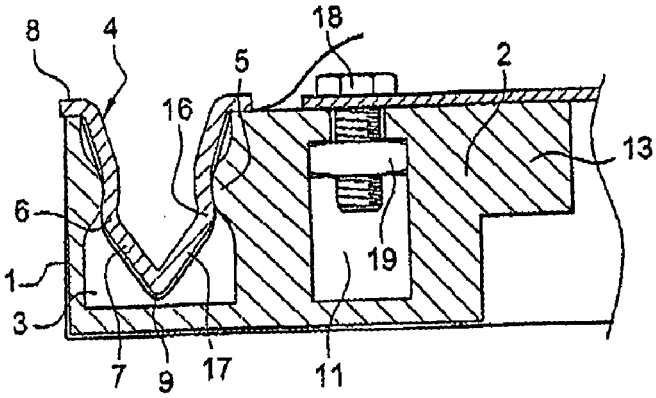
Fig. 3

DEVICE FOR TENSIONING AND SECURING A CANVAS

FIELD OF THE INVENTION

The present invention relates to devices that can be used to tension and secure a canvas or a sheet of paper. Such devices may, for example, be used to post public poster advertising or as art or decorative frames.

The invention relates more especially to a frame or stretcher structure combined with an arrangement of components in recesses making it possible to reversibly attach a canvas to a stretcher by wedging.

DESCRIPTION OF THE PRIOR ART

Generally speaking, the use of elongated deformable battens to reversibly attach a canvas to a stretcher by wedging is known.

Document FR 2 639 879 describes a stretcher for a canvas having a groove around its periphery. The tensioning device consists of an elongated batten comprising a flat base emerging from the groove and two parallel wings which protrude from said flat base and have enlargements on their opposite surfaces intended to click into a restricted mouth of the groove made in the stretcher.

The tensioning device has portions that are substantially perpendicular which are subjected to shear stresses in the area where they are joined when the two protruding wings are inserted into the mouth of the groove. Although this deformation is necessary in order to wedge the canvas into the groove of the stretcher, it nevertheless makes the batten fragile and even destroys it after a certain number of uses.

In addition, with such a device, wedging of the canvas is obtained on the ends of the walls that form the restricted mouth of the groove by means of two sharp opposite-facing edges. This arrangement then creates friction on the sharp edges which will consequently damage the canvas each time the batten is fitted into or removed from the groove.

Document BE 848 203 also describes a device making it possible to tension and secure a canvas on a frame. In this case a batten penetrates into a U-shaped groove. The batten may, in particular, have a V-shaped cross section and wedge the canvas by means of the two long edges of the wings of the V. The canvas is therefore wedged between a flat surface of the groove and a sharp edge of the batten.

Consequently, as before, this type of arrangement quickly damages the canvas and does not make it possible to repeatedly mount and dismount the canvas from the frame without damaging it.

SUMMARY OF THE INVENTION

The present invention therefore relates to a device capable of tensioning and securing a canvas comprising a stretcher having a groove and at least one deformable batten. The canvas is tensioned and secured on the stretcher by wedging it between the groove and the deformable batten.

This deformable batten has a substantially V-shaped section which is oriented towards the bottom of the groove. The deformable batten comprises a sharp edge which is used as a pivot to enable the deformation thereof and two flanks which are used to wedge the canvas in the groove.

In other words, the two flanks of the batten which allow wedging pivot relative to the sharp edge of the V which is oriented towards the bottom of the groove.

According to the invention, the device is characterised in that the batten is locked in a narrow section of the groove by means of two enlargements each extending on one flank of the batten in the same direction as the batten.

In other words, the batten is a profile that has two flanks which each have an enlargement on their outer surface.

The batten has a clearance between the enlargements on its flanks which is wider than the narrow section of the stretcher's groove. Pressure exerted on the inside of the batten and the sharp edge of the V makes it possible to move the flanks of the V together thereby allowing the batten to be pushed down into the groove of the stretcher. The enlargements then penetrate into the narrow section and produce self-locking assembly of the canvas.

Thus, wedging of the canvas is obtained between two tangential surfaces inside the groove and near the narrow section. Consequently, the canvas can be mounted and dismounted from the frame without being damaged.

In practice, the batten may also comprise two flaps which extend the flanks and emerge from the groove to make it possible to grip and extract the batten which is locked in the groove.

Depending on the application, the batten which ensures wedging may extend over the entire side or be formed by a plurality of separate lengths.

In other words, in this latter case, in a given direction and on the same side of the stretcher, the canvas can be wedged into a groove by means of several separate components forming lengths of separate battens.

In certain situations, the stretcher can be disassembled into a plurality of segments. This makes it easier to transport and handle.

Advantageously, the stretcher may comprise a plurality of features making it possible to separately mount bracing in order to join, two by two, segments located, in particular, on the opposite sides of the stretcher. These features may be in the form of grooves capable of accommodating means of reversible attachment.

In one particular embodiment, the stretcher may comprise means of hook fastening in order to mount it on a wall. In other words, the stretcher may have a special geometry intended to facilitate hanging it on a wall or, more generally, any type of partition wall.

In practice, fitting the battens can be made easier by means of a tool comprising a rounded edge making it possible to exert pressure on the inside surface of the battens.

A kit comprising a stretcher and battens as well as a tool can be supplied with the canvas and sold as such, i.e. not assembled, in order to reduce the cost of labour, storage and handling.

The user then assembles the frame and positions the canvas relative to it. Cutting the canvas to size very accurately combined with positioning relative to a registration mark on the stretcher makes it possible to apply a predetermined tension to the canvas every time it is mounted. This is made possible by using a canvas made of a non stretchable material.

Consequently, tensioning the canvas does not require any adjustment on the part of the user and is determined by the actual design of the canvas depending on the material used and its dimensions.

BRIEF DESCRIPTION OF THE DRAWINGS

The way in which the invention is embodied and its resulting advantages will become more apparent from the description of the following embodiment, given merely by way of example, reference being made to the accompanying drawings in which:

FIG. 1 is a perspective view of the device according to the invention;

FIG. 2 is a cross-sectional view of the device before insertion of the batten which produces wedging of the canvas into the groove according to the invention.

FIG. 3 is a cross-sectional view of the batten which produces wedging of the canvas into the groove according to the invention.

DESCRIPTION OF THE PREFERRED EMBODIMENTS

As already stated, the invention relates to a device capable of tensioning and securing a canvas comprising a stretcher having a groove and at least one deformable batten.

As shown in FIG. 1, the device comprises a stretcher (2) on which a canvas (1) is mounted. The canvas (1) is tensioned and secured by wedging the canvas (1) in a groove (3) by means of battens (4).

In the form illustrated, the battens (4) are inserted onto the rear surface of the stretcher (2) but they can also be inserted on any other surface of the stretcher.

FIG. 1 shows two separate embodiments. On one of the sides of the stretcher (2), a deformable batten (4) extends over the entire length of the groove whereas on another side the deformable batten (4) comprises a plurality of independent lengths (14, 24). Depending on the application and the dimensions of the stretcher (2), these embodiments may or may not be combined as desired.

Bracing (12) is used to make the structure of the stretcher (2) more rigid. This bracing (12) can be attached to the various lengths that form the stretcher (2) by means of a plurality of features (11) which are shown here in the form of grooves into which a square nut can be inserted. A screw is then used to reversibly attach the bracing (12) to the stretcher (2).

As is apparent in FIG. 2, the deformable battens (4) have a substantially V-shaped section which is oriented towards the bottom of the groove (3). The deformable battens (4) each comprise a sharp edge (9) which is used as a pivot to enable the deformation thereof and two flanks (7, 17) which are used to wedge the canvas (1) in the groove (3).

Wedging of the canvas (1) in the groove (3) is obtained by means of the two flanks (7, 17) of the batten (4) or (14, 24).

A hook-fastening portion (13) may emerge from the profile in a localised or continuous fashion over the entire length of the profile in order to make it easier to attach the stretcher on a wall using the hook.

As shown in FIG. 3, wedging is obtained by means of two enlargements (6, 16) made on flanks (7, 17) of batten (4) and by a narrow section (5) inside groove (3). The enlargements (6, 16) are wedged against contact arcuate portions of the narrow section (5) that are oriented towards the bottom of the groove (3).

Deformation of the two flanks (7, 17) occurs when the batten(4) is inserted into the groove (3) by pivoting around a sharp edge of the batten (4).

Flaps (8) that extend the two flanks (7, 17) of batten (4) outside the groove make it possible to extract the batten (4) when it is locked in the groove (3).

The groove making it possible to attach the bracing (12) has a narrowed opening which allows a screw (18) to pass through but prevents a square nut (19) from escaping the groove. The various lengths of the stretcher (2) are made in this way as a profile which can have one or more grooves.

From the above description, it is apparent that a device in accordance with the invention has many advantages, in particular:

- the geometry of the batten makes it possible to provide a large degree of elasticity capable of withstanding a large number of successive deformation cycles;
- the method of manufacturing the deformable batten is simple to use and relatively inexpensive, e.g. an extrusion process, in particular;
- finally, the density per metre length of such a profile is very low and this makes it an inexpensive component.

The invention claimed is:

1. A device capable of tensioning and securing a canvas, the device comprising:

a stretcher comprising a groove having an opening along a surface of the stretcher and having a narrow section located a distance from the opening, the narrow section being formed at least in part by two contact arcuate portions that are oriented towards a bottom of the groove opposite the opening; and at least one deformable batten, the deformable batten having a substantially V-shaped section, which is oriented towards the bottom of the groove, the V-shaped section having a sharp edge, which is used as a pivot to enable the deformation thereof, and two flanks extending from the sharp edge, each of the two flanks having an enlargement extending therefrom that is used to wedge the canvas in the groove, wherein the batten is locked in the narrow section of the groove by means of the two enlargements engaging with the contact arcuate portions.

2. The device as claimed in claim 1, wherein the batten further comprises two flaps, which extend the flanks of the batten and emerge from the opening of the groove to make it possible to grip and extract the batten when it is locked in the groove.

3. The device as claimed in claim 1, wherein each batten is formed by a plurality of separate batten lengths.

4. The device as claimed in claim 1, wherein the stretcher can be disassembled into a plurality of segments.

5. The device as claimed in claim 4, wherein the stretcher comprises a plurality of grooves making it possible to separately mount bracing in order to join, two by two, the segments that form the stretcher.

6. The device as claimed in claim 1, wherein the stretcher further comprises a hook-fastening portion for mounting it on a wall.

7. The device as claimed in claim 1, further comprising a tool comprising a rounded edge adapted to exert pressure on the inside surface of battens to facilitate fitting the battens that produce tensioning and secure the canvas.

* * * * *